US007607931B2

(12) United States Patent
Saitoh et al.

(10) Patent No.: US 7,607,931 B2
(45) Date of Patent: Oct. 27, 2009

(54) TEST SOCKET ADJUSTABLE TO SOLID STATE IMAGE PICKUP DEVICES OF DIFFERENT SIZES

(75) Inventors: Hitoshi Saitoh, Sakurai (JP); Makoto Tsuji, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/204,179

(22) Filed: Sep. 4, 2008

(65) Prior Publication Data

US 2009/0075514 A1 Mar. 19, 2009

(30) Foreign Application Priority Data

Sep. 14, 2007 (JP) ..... 2007-238827

(51) Int. Cl.
*H01R 13/62* (2006.01)

(52) U.S. Cl. ..... 439/331

(58) Field of Classification Search ..... 439/330, 439/331, 70, 73, 219, 266, 71; 324/755
See application file for complete search history.

(56) References Cited

U.S. PATENT DOCUMENTS 4,671,592 A * 6/1987 Ignasiak et al. ..... 439/331
4,768,972 A * 9/1988 Ignasiak et al. ..... 439/330
5,718,595 A * 2/1998 Tohyama et al. ..... 439/330
6,296,504 B1 * 10/2001 Ohashi ..... 439/266
6,402,537 B2 * 6/2002 Ikeya ..... 439/259
6,488,522 B2 * 12/2002 Fukunaga ..... 439/331
6,537,093 B2 * 3/2003 Kanesashi et al. ..... 439/268
6,631,556 B2 * 10/2003 Lee ..... 29/832
6,984,142 B2 * 1/2006 Shimizu ..... 439/268
7,338,295 B2 * 3/2008 Wooden ..... 439/73

FOREIGN PATENT DOCUMENTS

JP 2007-109534 4/2007

* cited by examiner

*Primary Examiner*—Chandrika Prasad
(74) *Attorney, Agent, or Firm*—Nixon & Vanderhye P.C.

(57) ABSTRACT

Provided is a test socket capable of being used more flexibly for solid-state image pickup devices of different shapes and of performing locating of the solid-state image pickup devices more precisely. The test socket houses a device under test (DUT) which is a solid-state image pickup device while a test is being performed. The test socket comprises: first locating means for locating the DUT in an X direction parallel to a ceiling plane of the DUT in a housed state; urging means for urging the first locating means in a Z direction perpendicular to the ceiling plane of the DUT in the housed state; and position setting means for setting an upper limit of movement in the Z direction of the first locating means caused by the urging means to set a position in the Z direction of the first locating means relative to the DUT.

4 Claims, 7 Drawing Sheets

TEST SOCKET ADJUSTABLE TO SOLID STATE IMAGE PICKUP DEVICES OF DIFFERENT SIZES

CROSS REFERENCE TO RELATED APPLICATION

This Nonprovisional application claims priority under 35 U.S.C. §119(a) on Patent Application No. 2007-238827 filed in Japan on Sep. 14, 2007, the entire contents of which are hereby incorporated by reference.

BACKGROUND

1. Field of the Technology

The technology presented herein relates to a test socket including locating means for locating a solid-state image pickup device fitted therein.

The present invention relates to a socket configured to locate a solid-state image pickup device inserted therein so as to enable optical centering at all times, and hence being adaptable to solid-state image pickup devices of different sizes.

2. Description of the Related Art

Recently, with the remarkable advancement in performance of image pickup instruments using solid-state image pickup devices, such as cellular phones with a camera function and digital still cameras, the solid-state image pickup devices have also become increasingly advanced in performance, e.g., having a mega number of pixels and a wide angle of view. In addition, some solid-state image pickup devices are densely packed by mounting a circuit board, such as a flexible printed board or a rigid board, implementing a camera driving circuit thereon.

In a manufacturing process of solid-state image pickup devices, various tests are conventionally performed to screen out defective products. The test of a solid-state image pickup device is usually performed with the solid-state image pickup device of the test target being fitted in a test socket provided in a tester for electrical testing, characteristic evaluation, or the like.

The structure of a test socket for a solid-state image pickup device is briefly described below with reference to FIG. 7. FIG. 7 illustrates an exemplary schematic configuration of a conventional test socket for a solid-state image pickup device, in particular, of a test socket 100 for a solid-state image pickup device mounted with a circuit board.

As shown in FIG. 7, the test socket 100 includes a base 110 and a cover 120 to house a solid-state image pickup device. The base 110 is provided with a first recess 111 that conforms to the lower shape of the main body including the circuit board of the solid-state image pickup device. The cover 120 is provided, at a position corresponding to the position of the first recess 111, with a second recess 121 that conforms to the upper shape of the main body including the circuit board of the solid-state image pickup device. The first recess 111 provided in the base 110 and the second recess 121 provided in the cover 120 jointly house the solid-state image pickup device. A contact portion including a plurality of contact pins is provided on the bottom surface of the first recess 111 in the base 110 so as to establish electrical connection with terminals of the solid-state image pickup device. It should be noted that the first recess 111 in the base 110 and the second recess 121 in the cover 120 are usually provided with some play to allow the solid-state image pickup device to be smoothly fitted/released.

In order to perform a test in a favorable manner for a solid-state image pickup device, especially for a high-performance solid-state image pickup device as mentioned above, the focal point and angle of view of the solid-state image pickup device should be adjusted to an optical center as accurately as possible. As described above, however, since the first recess 111 in the base 110 and the second recess 121 in the cover 120 of the test socket 100 are usually provided with some play, the solid-state image pickup device should be located as precisely as possible in order to perform the test with a satisfactory degree of accuracy.

Exemplary techniques for locating a solid-state image pickup device in a test socket include one using a test socket having, as locating means for locating and fixing the solid-state image pickup device in a direction (a first direction) parallel to the ceiling plane of the solid-state image pickup device in a housed state, movable chucks to urge toward the center each of predetermined two diagonal corners out of the corners of the solid-state image pickup device (see, e.g., Japanese Unexamined Patent Publication No. 2007-109534).

In a case, however, where, e.g., a test is performed using a conventional test socket on a solid-state image pickup device mounted with a circuit board, and the circuit board is mounted at such a position that locating means of the test socket contacts the solid-state image pickup device, it is sometimes difficult to locate the solid-state image pickup device in fitting the solid-state image pickup device into the test socket, because of, e.g., the contact between the locating means and the circuit board. In such a case, there arises a need to fabricate a test socket dedicated for each of the shapes of solid-state image pickup devices so as to accommodate different shapes of the solid-state image pickup devices.

SUMMARY

The technology presented herein was made in view of the foregoing problems, and it is a feature of the present technology to provide a test socket capable of being used more flexibly for solid-state image pickup devices of different shapes and of performing locating of the solid-state image pickup devices more precisely.

According to a first feature, a test socket according to an example embodiment for achieving the above feature relates to a test socket for housing a device under test ("DUT")while a test is being performed, the DUT being a solid-state image pickup device, the test socket comprising: first locating means for locating the DUT in a first direction parallel to a ceiling plane of the DUT in the housed state; urging means for urging the first locating means in a second direction perpendicular to the ceiling plane of the DUT in the housed state; and position setting means for setting an upper limit of the movement in the second direction of the first locating means caused by the urging means to set a position in the second direction of the first locating means relative to the DUT.

According to a second feature, in the test socket according to the above feature of the example embodiment, the first locating means may comprise: a first fixing portion that is disposed on the test socket fixedly with respect to the first direction and supports a first corner which is one of corners on a diagonal of the DUT; and a second fixing portion that is provided in a slidable manner in a direction parallel to the diagonal of the DUT and urges, toward the first fixing portion, a second corner which is the other of the corners on the diagonal of the DUT.

According to a third feature, in the test socket according to any of the above features of the example embodiment, the urging means and a contact portion including a plurality of contact terminals to establish electrical connection with terminals of the DUT may be provided at a side opposite in direction to the second direction with respect to the first locating means, and the test socket may further comprise second locating means for urging the DUT in a direction opposite to the second direction from a side along the second direction with respect to the first locating means to fix a position of the ceiling plane of the DUT to a predetermined ceiling position.

According to a fourth feature, in the test socket according to the above feature of the example embodiment, the contact terminals may be arranged in a matrix in the contact portion.

Since the test socket according to the above-described features includes the urging means for urging the first locating means in the second direction and the position setting means for setting the upper limit of the movement in the second direction of the first locating means caused by the urging means, it becomes possible to control the position in the second direction of the first locating means as appropriate relative to the solid-state image pickup device in the housed state. With this structure, in the case of, e.g., performing a test on a solid-state image pickup device mounted with a circuit board, the test socket according to the above-described features can set the position where the first locating means contacts the solid-state image pickup device to a position outside the circuit board mounting portion. Accordingly, the test socket according to the above-described features can be used for solid-state image pickup devices of different shapes more flexibly, hence allowing a solid-state image pickup device to be housed and fixed therein regardless of present or absence of a built-in circuit board.

Also, since the test socket according to the above-described features includes the first locating means for locating the solid-state image pickup device in the direction (the first direction) parallel to the ceiling plane of the solid-state image pickup device in the housed state, the locating in the first direction can be performed accurately. With this structure, the focal point and angle of view of a solid-state image pickup device can be adjusted more accurately to an optical center.

In the test socket according to the second feature, the first locating means may include the first fixing portion that supports and fixes the first corner of the solid-state image pickup device and the second fixing portion that urges the second corner of the solid-state image pickup device toward the first corner, the second corner being diagonally across the first corner; therefore, the first locating means can be provided in a simple structure, and the locating in the first direction can be carried out accurately.

The test socket according to the third feature may include the second locating means for urging the DUT from the side along the second direction of the first locating means in the direction opposite to the second direction, so as to fix the position of the ceiling plane of the DUT to a predetermined ceiling position; therefore, the locating in the second direction can be performed accurately.

The test socket according to the fourth feature may include the contact portion in which the contact terminals are arranged in a matrix; therefore, the same test socket can be used for the solid-state image pickup devices that have the same side-to-terminal distance and the same terminal interval. Accordingly, it becomes possible to cut costs involved in the test and reduce the time required for developing test sockets.

DESCRIPTION OF THE PREFERRED EMBODIMENTS

Embodiments of a test socket are described below with reference to the drawings.

Figure 1:
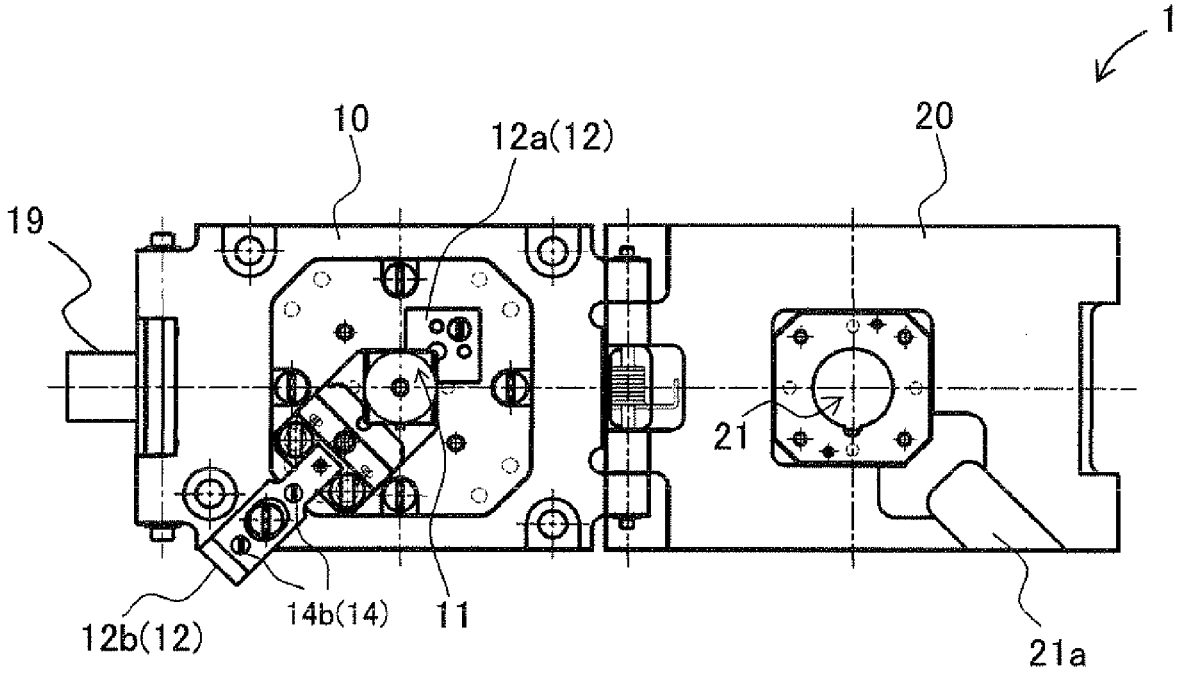
FIG. 1 is a top view showing an exemplary schematic configuration of an opened test socket according to an example embodiment.
Figure 2A:
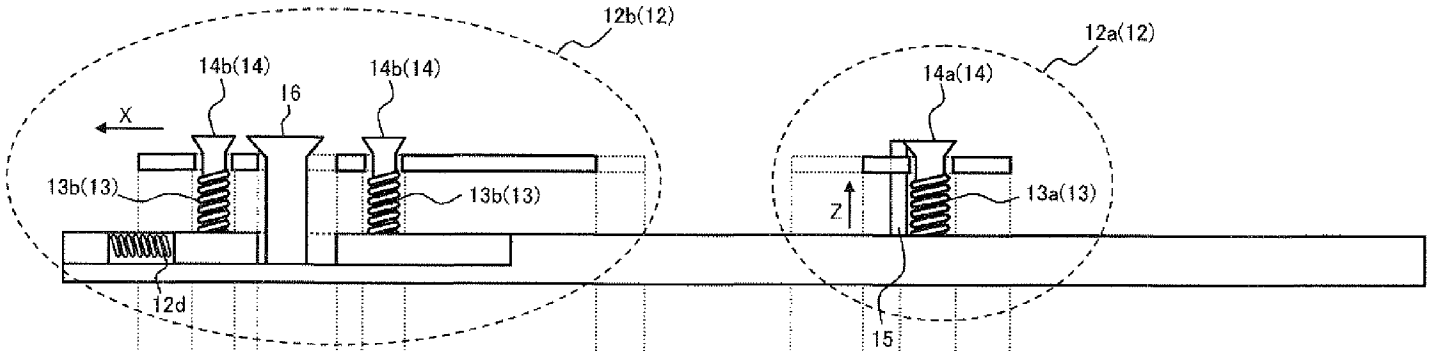
FIGS. 2A and 2B are schematic views showing exemplary configurations of main portions of a base of the test socket according to an example embodiment.
Figure 2B:
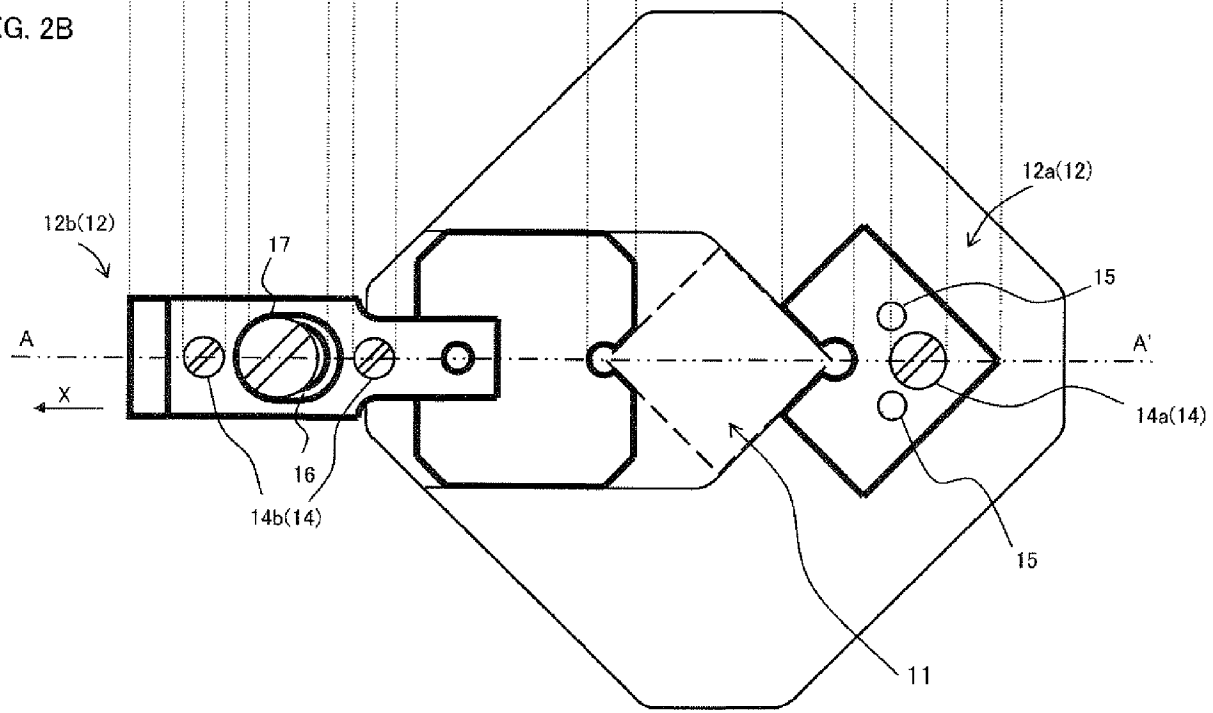

A structure of a test socket according to an example embodiment is described with reference to FIGS. 1 to 6. FIG. 1 shows an exemplary schematic configuration of an opened test socket 1 according to an example embodiment. FIGS. 2A and 2B show exemplary schematic configurations of main portions of a base 10 to be described later of the test socket 1 shown in FIG. 1, where FIG. 2A is a cross-sectional view taken along line A-A' in FIG. 2B, and FIG. 2B is a top view of the base 10. It should be noted that the present embodiment is described on the assumption that the DUT to be housed in the test socket is a solid-state image pickup device that includes a circuit board in a lower portion of its main body and an image pickup portion on its ceiling plane.

As shown in FIG. 1, the test socket 1 includes the base 10 and a cover 20 that have an approximately rectangular solid shape. As in the conventional technique, the base 10 is provided with a first recess 11 that conforms to the lower shape of the main body including the circuit board of the DUT, whereas the cover 20 is provided, at a position corresponding to the first recess 11, with a second recess 21 that conforms to the upper shape of the main body including the circuit board of the DUT. The first recess 11 provided in the base 10 and the second recess 21 provided in the cover 20 jointly house the DUT. It should be noted that, as in the conventional technique, the first recess 11 in the base 10 and the second recess 21 in the cover 20 are provided with some play so as to allow the DUT to be smoothly fitted/released. Moreover, the test socket 1 includes a latch member 19 for interlocking the cover 20 with the base 10.

As shown in FIGS. 1, 2A, and 2B, the base 10 includes first locating means 12, urging means 13, and position setting means 14. The first locating means 12 locates the DUT in an X direction (corresponding to the first direction) parallel to the ceiling plane of the DUT in a housed state. The urging means 13 urges the first locating means 12 in a Z direction (corresponding to the second direction) perpendicular to the ceiling plane of the DUT in the housed state. The position setting means 14 sets an upper limit of the movement in the Z direction of the first locating means 12 caused by the urging means 13 and sets the position in the Z direction of the first locating means 12 relative to the DUT. It should be noted that the present embodiment is described on the assumption that the urging means 13 uses springs 13, and that the position setting means 14 uses screws 14.

More specifically, as shown in FIGS. 2A and 2B, the first locating means 12 of the base 10 includes first and second fixing portions 12*a* and 12*b*. The first fixing portion 12*a* is disposed on the test socket 1 fixedly with respect to the X direction and supports a first corner which is one of the corners on a diagonal AA' of the DUT in a housed state. The second fixing portion 12*b* is provided in a slidable manner in a direction parallel to the diagonal AA' (the X direction in the present embodiment) and urges a second corner which is the other of the corners on the diagonal AA' toward the first fixing portion 12*a*.

As shown in FIGS. 2A and 2B, the first fixing portion 12*a* is constructed using an approximately L-shaped plate-like member with an approximately right-angled triangular cutout that fits the first corner of the DUT. The plate-like member includes a pair of openings that individually passes a pair of supports 15 in a slidable manner in the Z direction. The paired supports 15 are disposed in the respective openings in the plate-like member, so that the position of the first fixing portion 12*a* can be fixed in the X direction, and that the urging means 13 and the position setting means 14, as well as second locating means, can be moved in the Z direction, which will be described later.

As shown in FIGS. 2A and 2B, the plate-like member of the first fixing portion 12*a* includes an opening to pass a screw 14*a* serving as the position setting means 14 in a slidable manner in the Z direction. The screw 14*a* is passed through the opening in the plate-like member of the first fixing portion 12*a*, past a spring 13*a* serving as the urging means 13, and is partly fastened to the base 10. The plate-like member of the first fixing portion 12*a* is urged in the Z direction by the spring 13*a* disposed between the plate-like member of the first fixing portion 12*a* and the base (i.e., fitted at the side opposite in direction to the Z direction of the first locating means 12). While the test socket 1 is opened, the plate-like member of the first fixing portion 12*a* is fixed in contact with a thread of the screw 14*a*. That is, the fastening tightness of the screw 14*a* determines an upper limit of movement in the Z direction of the plate-like member of the first fixing portion 12*a*. The screw 14*a* may be fastened tightly to the base 10 to set the upper limit of the movement at a low position, whereas the screw 14*a* may be fastened loosely to the base 10 to set to upper limit of the movement at a high position.

As shown in FIGS. 2A and 2B, the second fixing portion 12*b* includes a plate-like member with an approximately right-angled triangular cutout 12*c* that fits the second corner of the DUT, as well as a spring 12*d* to urge the plate-like member in the X direction. The plate-like member includes an opening 17 to pass a support 16 therethrough. The opening 17 is approximately formed into a track so as to permit the plate-like member of the second fixing portion 12*b* to slide in the X and Z directions by disposing the support 16 in the opening 17.

Figure 3:
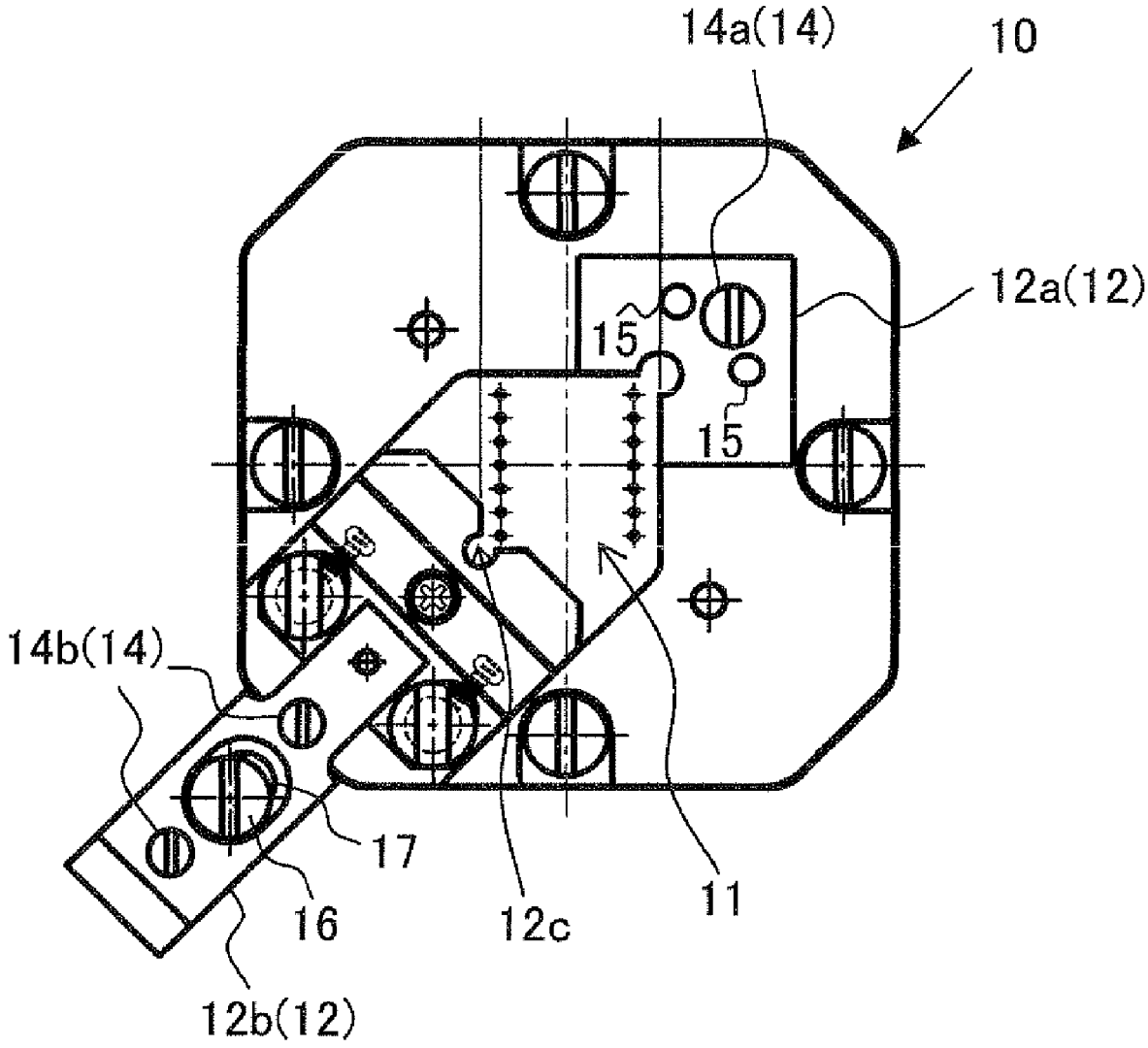
FIG. 3 is a top view showing an exemplary schematic configuration of the base of the test socket according to an example embodiment with a device under test (DUT) fixed therein.
Figure 4:
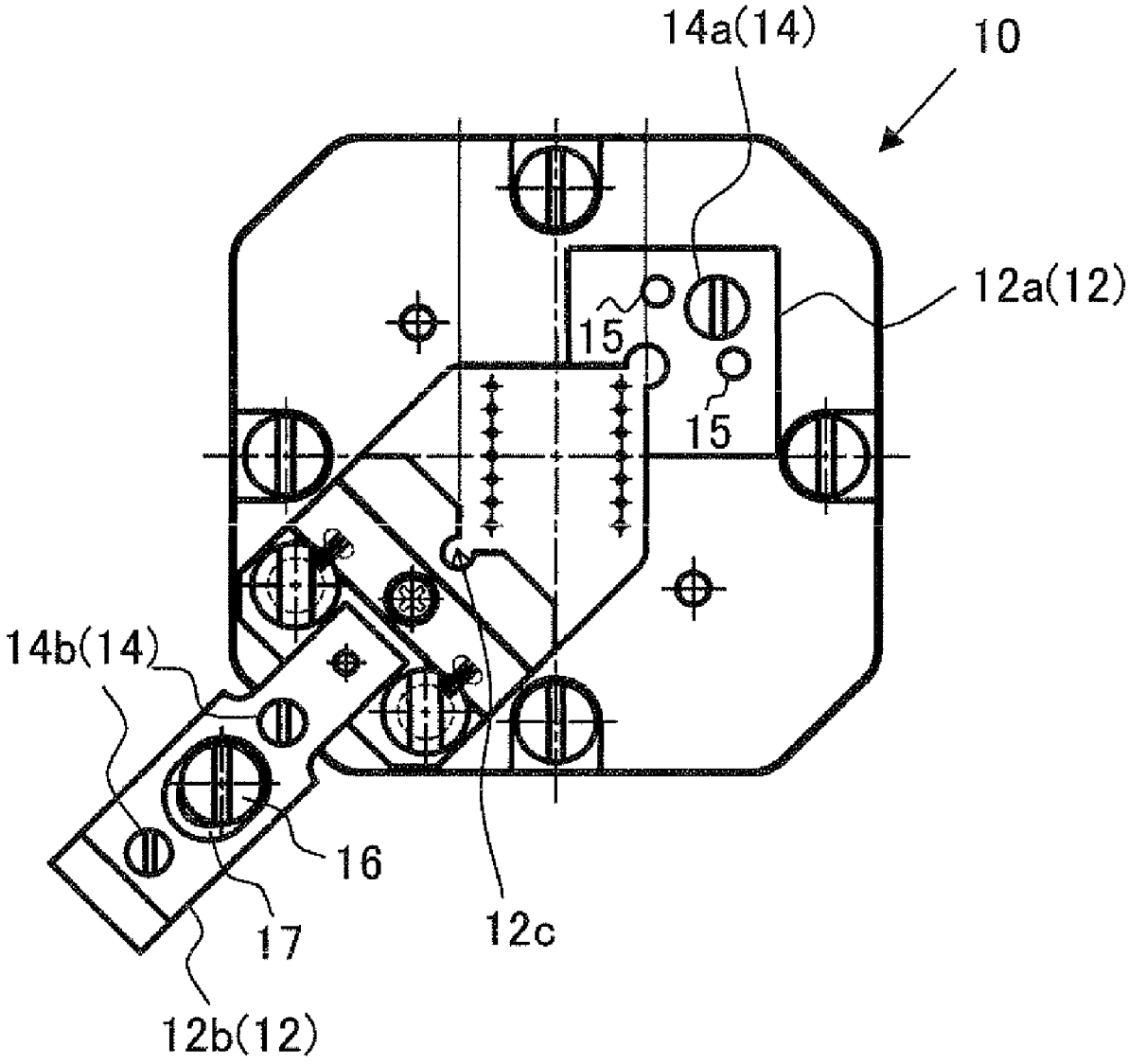
FIG. 4 is a top view showing an exemplary schematic configuration of the base of the test socket according to an example embodiment, where the DUT can be fitted or released.

FIG. 3 shows a positional relationship between the second fixing portion 12*b* and the base 10 while the DUT can be fitted/released, whereas FIG. 4 shows a positional relationship between the second fixing portion 12*b* and the base 10 while the DUT is fixed. To fit the DUT in the test socket 1, the second fixing portion 12*b* is first moved in the X direction to bring the test socket 1 into the receivable state shown in FIG. 3, and the lower portion of the DUT is inserted into the first recess 11 of the base 10. The spring 12*d* urges the second fixing portion 12*b* in a direction opposite to the X direction, whereby the DUT is located in the X direction with its first and second corners held by the first and second fixing portions 12*a* and 12*b*. The DUT can be located accurately with its first corner being fixed at the same position, i.e., meeting the cutout of the first fixing portion 12*a*, at all times.

Further, as shown in FIGS. 2A and 2B, the plate-like member of the second fixing portion 12*b* includes a pair of openings to pass a pair of screws 14*b* serving as the position setting means 14 in a slidable manner in the Z direction. The screws 14*b* are passed through the respective openings in the plate-like member of the second fixing portion 12*b*, past springs 13*b* serving as the urging means 13, and are partly fastened to the base 10. The plate-like member of the second fixing portion 12*b* is urged in the Z direction by the springs 13*b* disposed between the plate-like member of the second fixing portion 12*b* and the base. While the test socket 1 is opened, the plate-like member of the second fixing portion 12*b* is fixed in contact with threads of the screws 14*b*. That is, the fastening tightness of the screws 14*b* determines an upper limit of the movement in the Z direction of the plate-like member of the second fixing portion 12*b*. The screws 14*b* may be fastened tightly to the base 10 to set the upper limit of the movement at a low position, whilst the screws 14*b* may be fastened loosely to the base 10 to set the upper limit of the movement at a high position.

It should be noted that the screw 14*a* for setting the upper limit of the movement in the Z direction of the first fixing portion 12*a* and the screws 14*b* for setting the upper limit of the movement in the Z direction of the second fixing portion 12*b* are desirably fastened to the base 10 such that the plate-like member of the first fixing portion 12*a* and the plate-like member of the second fixing portion 12*b* are set at an equal level; however, the technology presented herein is not limited thereto, and the setting is performed appropriately in view of the thicknesses of the plate-like members, the mounting position of the circuit board in the DUT, and the like. Accordingly, the DUT can be fixed with the first and second fixing portions 12*a* and 12*b* being kept from contacting the circuit board and the like of the DUT.

The base 10 is provided at its bottom with a contact portion 18 including a plurality of contact terminals 18*a* (contact pins 18*a*) so as to establish electrical connection with terminals of the DUT. In the present embodiment, the contact terminals 18*a* are arranged in a matrix in the contact portion 18.

Figure 5:
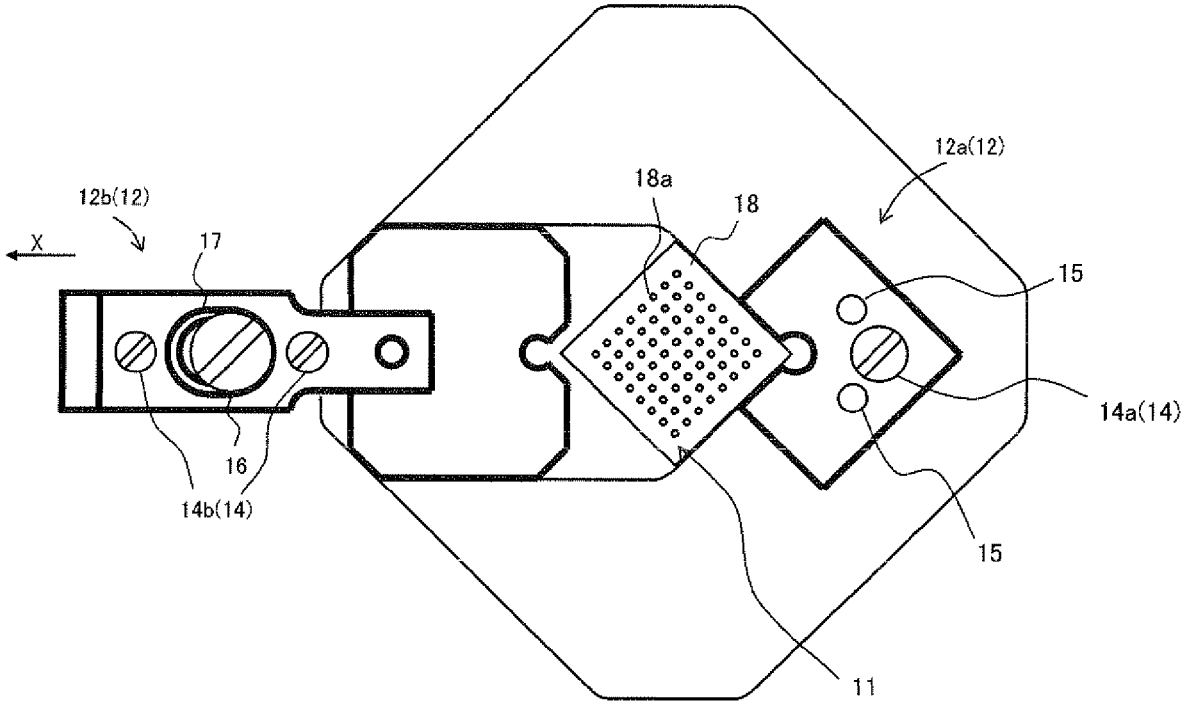
FIG. 5 is a top view showing an exemplary schematic configuration of a contact portion of the test socket according to an example embodiment.

FIG. 5 shows an exemplary schematic configuration of the contact portion 18. As described above, the second fixing portion 12*b* is constructed to be slidable in the X direction in FIGS. 2A, 2B, and 5. Accordingly, the present example embodiment is adaptable to, as shown in FIG. 5, solid-state image pickup devices that have the same end-to-terminal distance and the same terminal interval in DUTs thereof, and that are equal to or below the maximum size of the solid-state image pickup devices, which size is dependent on the number and arrangement of the contact terminals 18*a* of the contact portion 18.

The cover 20 to serve as the second locating means renders the test socket, with the DUT placed in the first recess 11 of the base 10, closed by interlocking with the base 10 through the latch member 19 to be described later, thereby urging the DUT in a direction opposite to the Z direction to fix the position of the ceiling plane of the DUT to a predetermined ceiling position. More specifically, in the present embodiment, the second recess 21 in the cover 20 is provided so as to contact the ceiling plane of the DUT, which allows the position in the Z direction of the image pickup portion provided on the ceiling plane of the DUT to be fixed at the same position relative to the cover 20 at all times.

Moreover, the cover 20 of the example embodiment includes a third recess 21*a* to ensure the movement of the second fixing portion 12*b*. The third recess 21*a* has a shape that conforms to the shape of the second fixing portion 12*b*.

Figure 6:
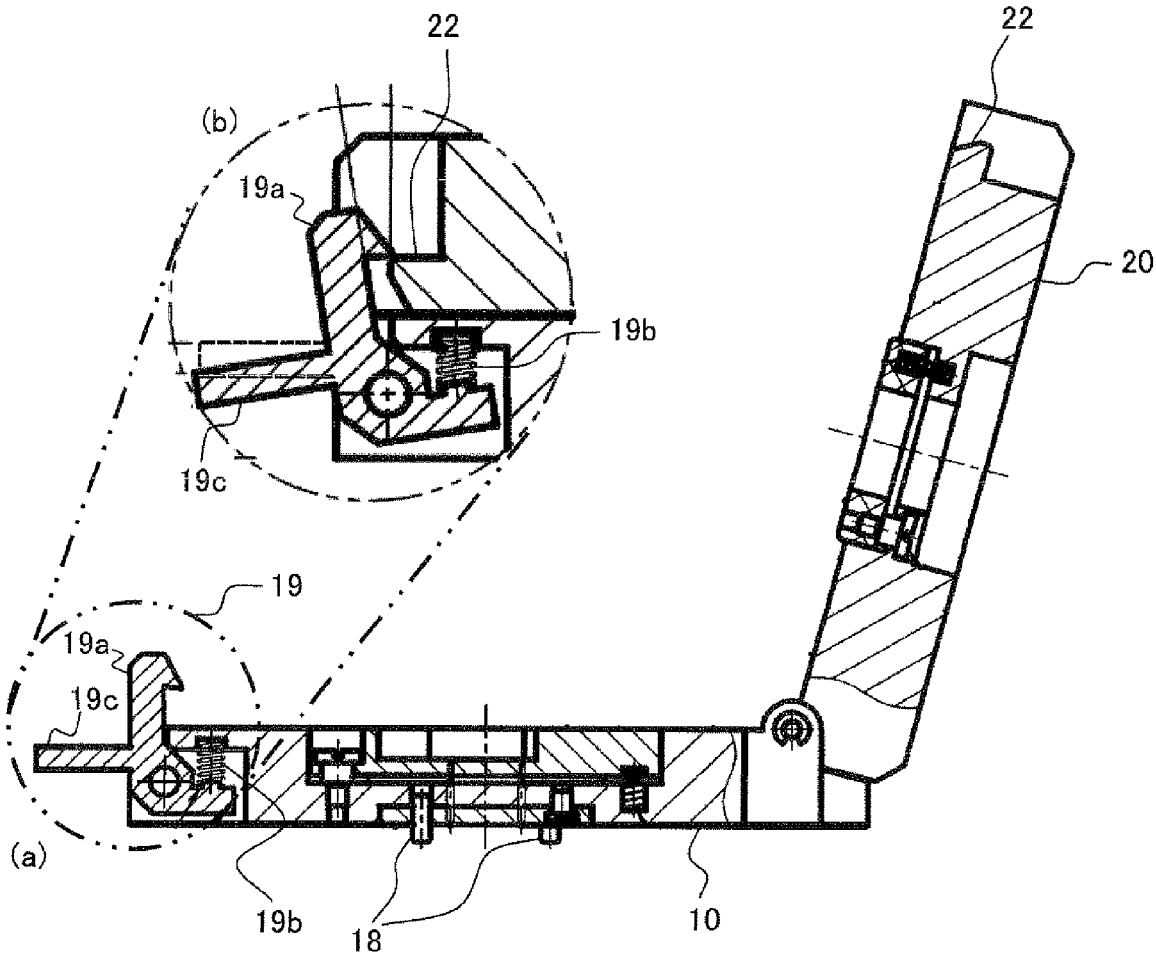
FIG. 6 is an end view showing a configuration of a latch member for interlocking a cover with the base.
Figure 7:
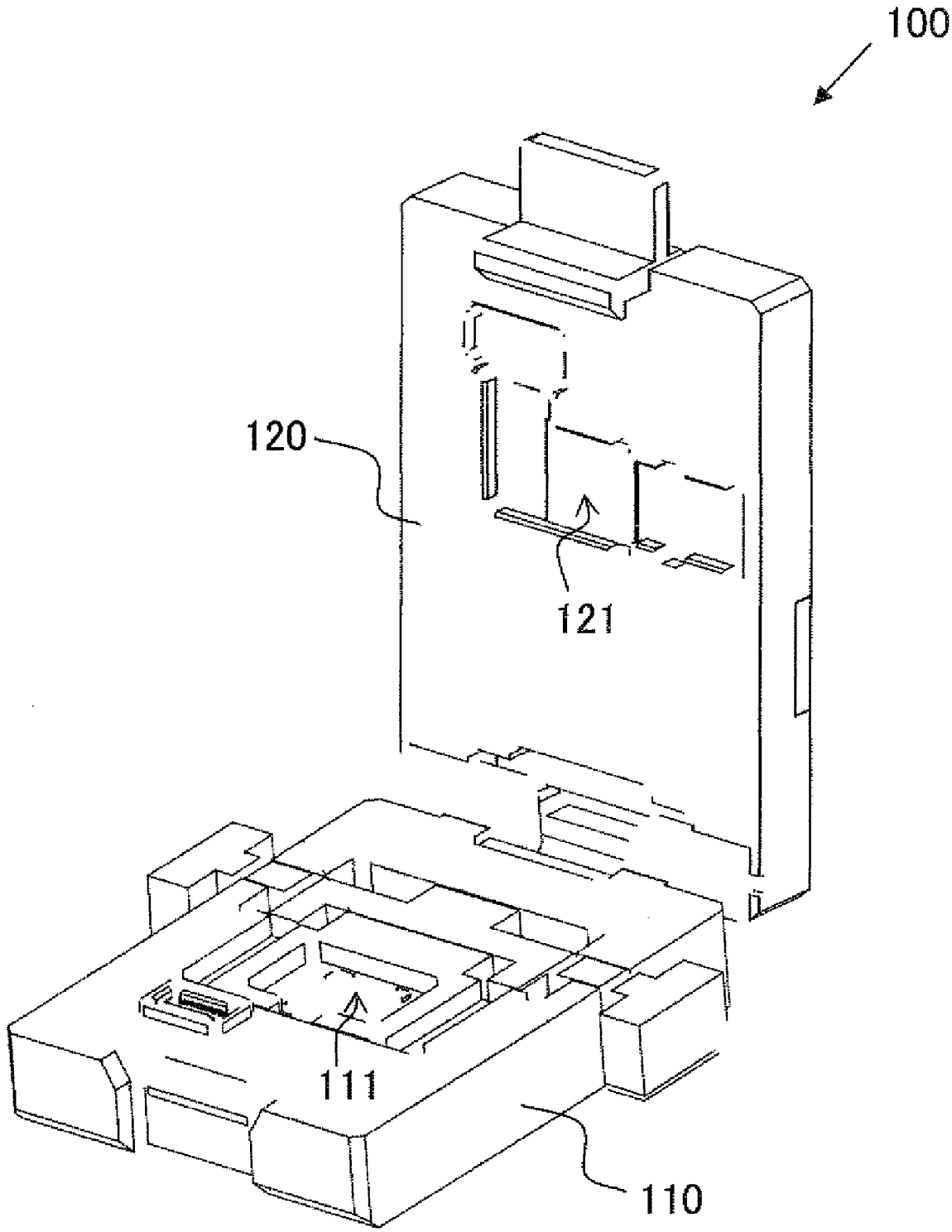
FIG. 7 Prior Art
FIG. 7 is a perspective view showing the schematic configuration of a conventional test socket for a solid-state image pickup device.

As shown in FIG. 6, the latch member 19 includes an interlocking portion 19*a*, a spring 19*b*, and a releasing portion 19*c*. The interlocking portion 19*a* of the latch member 19 is urged by the spring 19*b* toward the cover 20 to automatically interlock with an interlocking portion 22 of the cover 20 when the test socket 1 is closed. When the releasing portion 19*c* of the latch member 19 is pressed oppositely to the Z direction while the latch member 19 is interlocked, the cover 20 is released from the interlocking state. It should be noted that, in the present embodiment, as shown in FIG. 1, the base 10 and the cover 20 of the test socket 1 are urged in an opening direction, and thus the test socket will automatically be opened as shown in FIG. 1 upon release of the interlocking via the latch member 19.

Other Embodiments (1) The foregoing embodiment is described of a case in which the base 10 includes the first locating means 12, the urging means 13, and the position setting means 14; however, the example embodiment presented herein is not limited thereto, and the cover 20 may include all or part of these components.

(2) Although the foregoing embodiment is described on the assumption that the urging means 13 uses the springs 13 and the position setting means 14 uses the screws 14, the example embodiment presented herein is not limited thereto. The urging means 13 may be, e.g., an elastic member other than springs, a motor, or the like, and the position setting means 14 is constructed in accordance with the structure of the urging means 13.

(3) Although the foregoing embodiment is described based on an example where the DUT is a solid-state image pickup device mounted with a circuit board, the example embodiment presented herein is not limited thereto. The test socket according to the example embodiment is particularly useful for tested devices that are limited in area to be contacted by the first locating means 12. It should be noted that in a case of a solid-state image pickup device without a circuit board and the like, the position in the Z direction of the first locating means 12 can be selected so as to favorably fix the solid-state image pickup device in view of the structure of the device.

Although the technology presented herein has been described in terms of the preferred embodiment, it will be appreciated that various modifications and alternations might be made by those skilled in the art without departing from the spirit and scope of the example embodiments. The example embodiments should therefore be measured in terms of the claims which follow.

What is claimed is:

1. A test socket for housing a device under test while a test is being performed, the device under test being a solid-state image pickup device, the test socket comprising:

a first locating portion for locating the device under test in a first direction parallel to a ceiling plane of the device under test in a housed state;

an urging portion for urging the first locating portion in a second direction perpendicular to the ceiling plane of the device under test in the housed state; and a position setting portion for setting an upper limit of movement in the second direction of the first locating portion caused by the urging portion to set a position in the second direction of the first locating portion relative to the device under test.

2. The test socket according to claim 1, wherein the first locating portion comprises a first fixing portion that is disposed on the test socket fixedly with respect to the first direction and supports a first corner which is one of corners on a diagonal of the device under test and a second fixing portion that is provided in a slidable manner in a direction parallel to the diagonal of the device under test and urges, toward the first fixing portion, a second corner which is the other of the corners on the diagonal of the device under test.

3. The test socket according to claim 1, wherein the urging portion and a contact portion including a plurality of contact terminals to establish electrical connection with terminals of the device under test are provided at a side opposite in direction to the second direction with respect to the first locating portion, and wherein there is provided a second locating portion for urging the device under test in a direction opposite to the second direction from a side along the second direction with respect to the first locating portion to fix a position of the ceiling plane of the device under test to a predetermined ceiling position.

4. The test socket according to claim 3, wherein the contact terminals are arranged in a matrix in the contact portion.

* * * * *